US008623116B2

(12) United States Patent
Karlsson

(10) Patent No.: US 8,623,116 B2
(45) Date of Patent: Jan. 7, 2014

(54) METHOD AND A DEVICE FOR CONTROLLING THE POWER SUPPLIED TO AN ELECTROSTATIC PRECIPITATOR

(75) Inventor: Anders Nils Gustav Karlsson, Braas (SE)

(73) Assignee: ALSTOM Technology Ltd, Baden (CH)

( * ) Notice: Subject to any disclaimer, the term of this patent is extended or adjusted under 35 U.S.C. 154(b) by 466 days.

(21) Appl. No.: 13/121,970

(22) PCT Filed: Sep. 29, 2009

(86) PCT No.: PCT/EP2009/062603

§ 371 (c)(1), (2), (4) Date: Mar. 31, 2011

(87) PCT Pub. No.: WO2010/037737

PCT Pub. Date: Apr. 8, 2010

(65) Prior Publication Data

US 2011/0192280 A1 Aug. 11, 2011

(30) Foreign Application Priority Data

Oct. 1, 2008 (EP) ..... 08165629

(51) Int. Cl.
*B03C 3/68* (2006.01)

(52) U.S. Cl.
USPC ..... 95/4; 95/7; 95/80; 95/81; 96/19; 96/24; 96/75; 96/80; 323/903

(58) Field of Classification Search
USPC ..... 95/4–7, 79–81; 96/19–24, 75, 80; 323/903
See application file for complete search history.

(56) References Cited

U.S. PATENT DOCUMENTS 3,989,486 A * 11/1976 Baysinger ..... 96/19
4,229,411 A * 10/1980 Kisters et al. ..... 422/62

(Continued)

FOREIGN PATENT DOCUMENTS

GB 2144003 7/1984
JP 4-145964 A * 5/1992 ..... 95/4
JP 2006-112383 4/2006

OTHER PUBLICATIONS

PCT International Search Report and Written Opinion of the International Searching Authority dated Jan. 19, 2010 (PCT/EP2009/062603).

(Continued)

*Primary Examiner* — Richard L Chiesa
(74) *Attorney, Agent, or Firm* — Rita D. Vacca

(57) ABSTRACT

Provided is a method of controlling the operation of an electrostatic precipitator (6) using a control strategy for a power to be applied between at least one collecting electrode (28) and at least one discharge electrode (26). The control strategy is directed to controlling, directly or indirectly, a power range and/or a power ramping rate. As such, the temperature of a process gas is measured. When the control strategy controls a power range, a power range is selected based on the measured temperature, an upper limit value of the power range being lower at a high temperature of said process gas, than at a low temperature. When the control strategy controls a power ramping rate, a power ramping rate is selected based on the measured temperature, a power ramping rate being lower at a high process gas temperature, than at a low process gas temperature.

12 Claims, 6 Drawing Sheets

(56) References Cited

U.S. PATENT DOCUMENTS

| | | | | | |
|---|---|---|---|---|---|
| 4,502,872 | A | * | 3/1985 | Ivester et al. | 96/90 |
| 4,624,685 | A | * | 11/1986 | Lueckenotte et al. | 95/3 |
| 4,816,979 | A | | 3/1989 | Domann et al. | |
| 4,844,723 | A | * | 7/1989 | Tellini et al. | 96/18 |
| 5,378,978 | A | | 1/1995 | Gallo et al. | |
| 5,911,213 | A | | 6/1999 | Ahlborn et al. | |
| 5,922,103 | A | * | 7/1999 | Schwab et al. | 95/8 |
| 6,245,131 | B1 | * | 6/2001 | Rippelmeyer et al. | 96/18 |
| 6,287,368 | B1 | * | 9/2001 | Ilmasti | 96/19 |
| 7,041,157 | B1 | * | 5/2006 | Fleck | 95/273 |
| 7,351,274 | B2 | * | 4/2008 | Helt et al. | 95/2 |
| 7,381,245 | B2 | * | 6/2008 | Fleischer | 96/18 |
| 2006/0249024 | A1 | * | 11/2006 | Shimoda et al. | 96/19 |

OTHER PUBLICATIONS

European Search Report dated Apr. 15, 2009.

* cited by examiner

Low temperature

High temperature

High temperature

High temperature

METHOD AND A DEVICE FOR CONTROLLING THE POWER SUPPLIED TO AN ELECTROSTATIC PRECIPITATOR

This is a US National Phase application claiming priority to International Application Serial No. PCT/EP09/62603 having an International Filing Date of Sep. 29, 2009, incorporated herein in its entirety by reference.

FIELD OF THE INVENTION

The present invention relates to a method of controlling the operation of an electrostatic precipitator, which is operative for removing dust particles from a process gas and which comprises at least one collecting electrode and at least one discharge electrode, with regard to the conditions of the process gas from which the dust particles are to be removed.

The present invention further relates to a device which is operative for controlling the operation of an electrostatic precipitator.

BACKGROUND OF THE INVENTION

In the combustion of a fuel, such as coal, oil, peat, waste, etc., in a combustion plant, such as a power plant, a hot process gas is generated, such process gas containing, among other components, dust particles, sometimes referred to as fly ash. The dust particles are often removed from the process gas by means of an electrostatic precipitator, also called ESP, for instance of the type illustrated in U.S. Pat. No. 4,502,872.

A combustion plant normally comprises a boiler in which the heat of the hot process gas is utilized for generating steam. The operating conditions of the boiler may vary from time to time depending on the degree of fouling on the heat transfer surfaces, the type and amount of fuel supplied, etc. The varying conditions in the boiler will cause varying conditions of the process gas that leaves the boiler and enters the ESP. The U.S. Pat. No. 4,624,685 describes an attempt to account for the varying process gas conditions in the control of an ESP. The flue gas temperature is accounted for as it has been found, in accordance with U.S. Pat. No. 4,624,685, that a higher temperature will result in a higher volumetric flow, the power of the ESP being controlled in accordance with the measured temperature to account for the varying volumetric flow of the process gas. Hence, an increased flue gas temperature is considered as corresponding to an increased volumetric flow requiring an increased power to the ESP.

Operating an ESP in accordance with U.S. Pat. No. 4,624,685 may be successful in the sense that emission limits can be coped with at varying conditions of the process gas. However, the electrical strain on the electrical components of the ESP tends to be quite high.

SUMMARY OF THE INVENTION

An object of the present invention is to provide a method of operating an electrostatic precipitator, ESP, by means of which method the life of the electrostatic precipitator, and in particular its electrical components, can be increased.

This object is achieved by a method of controlling the operation of an electrostatic precipitator, which is operative for removing dust particles from a process gas and which comprises at least one collecting electrode and at least one discharge electrode, with regard to the conditions of the process gas from which the dust particles are to be removed, said method being characterized in comprising:

utilizing a control strategy for a power to be applied between said at least one collecting electrode and said at least one discharge electrode, said control strategy comprising controlling, directly or indirectly, at least one of a power range and a power ramping rate, measuring the temperature of said process gas, selecting, when said control strategy comprises controlling the power range, a power range based on said measured temperature, an upper limit value of said power range being lower at a high temperature of said process gas, than at a low temperature of said process gas, selecting, when said control strategy comprises controlling the power ramping rate, a power ramping rate based on said measured temperature, said power ramping rate being lower at a high temperature of said process gas, than at a low temperature of said process gas, and controlling the power applied between said at least one collecting electrode and said at least one discharge electrode in accordance with said control strategy.

An advantage of this method is that the control of the power applied between at least one collecting electrode and at least one discharge electrode is made to depend on the flue gas temperature. Thus, at higher temperatures in the process gas, the power control can be performed in a manner which causes less wear to the electrical components of the electrostatic precipitator.

According to one embodiment of the present invention a relation between the process gas temperature, and the power applied between said at least one collecting electrode and said at least one discharge electrode is utilized when selecting said power range and/or said power ramping rate. An advantage of this embodiment is that the power range and/or the power ramping rate can be varied more or less continuously as a function of the temperature of the process gas. In some cases it may be preferable to utilize a relation that also accounts for the removal efficiency of the electrostatic precipitator.

According to one embodiment of the present invention said control strategy comprises controlling a power ramping rate. The power ramping rate often has a significant impact on the frequency of power cuts. Thus, controlling the power ramping rate in view of the temperature of the process gas tends to decrease the wear on the electrical equipment of the ESP significantly.

According to one embodiment of the present invention said control strategy comprises controlling both the power range and the power ramping rate. An advantage of this embodiment is that it provides for a large decrease in the strain on the electrical equipment of the ESP, compared to the prior art method.

According to one embodiment of the present invention said control strategy comprises applying at least two different power ramping rates during one and the same ramping sequence. One advantage of this embodiment is that it becomes possible to introduce more power into to the electrostatic precipitator. Preferably, an initial power ramping rate of said at least two different power ramping rates is higher than at least one following power ramping rate.

According to one embodiment of the present invention said control strategy comprises applying at least two different power ranges during one and the same ramping sequence.

A further object of the present invention is to provide a device which is operative for controlling the power supply of an electrostatic precipitator in such a manner that the life of the electrostatic precipitator, and in particular its electrical equipment, is increased.

This object is achieved by means of a device for controlling the operation of an electrostatic precipitator which is operative for removing dust particles from a process gas and which comprises at least one collecting electrode and at least one discharge electrode, with regard to the conditions of the process gas from which the dust particles are to be removed, said device being characterized in comprising:

a controller which is operative for controlling a power applied between said at least one collecting electrode and said at least one discharge electrode in accordance with a control strategy for the power to be applied between said at least one collecting electrode and said at least one discharge electrode, said control strategy comprising controlling, directly or indirectly, at least one of a power range and/or a power ramping rate, the controller being operative for receiving a signal indicating the temperature of the process gas and for selecting, when said control strategy comprises controlling the power range, a power range based on said measured temperature, an upper limit value of said power range being lower at a high temperature of said process gas, than at a low temperature of said process gas, and/or selecting, when said control strategy comprises controlling the power ramping rate, a power ramping rate based on said measured temperature, said power ramping rate being lower at a high temperature of said process gas, than at a low temperature of said process gas.

An advantage of this device is that it is operative for controlling the power applied between at least one collecting electrode and at least one discharge electrode in a manner which causes less wear to the electrical components of the electrostatic precipitator.

Further objects and features of the present invention will be apparent from the description and the claims.

BRIEF DESCRIPTION OF THE DRAWINGS

The invention will now be described in more detail with reference to the appended drawings in which.

DESCRIPTION OF PREFERRED EMBODIMENTS

Figure 1:
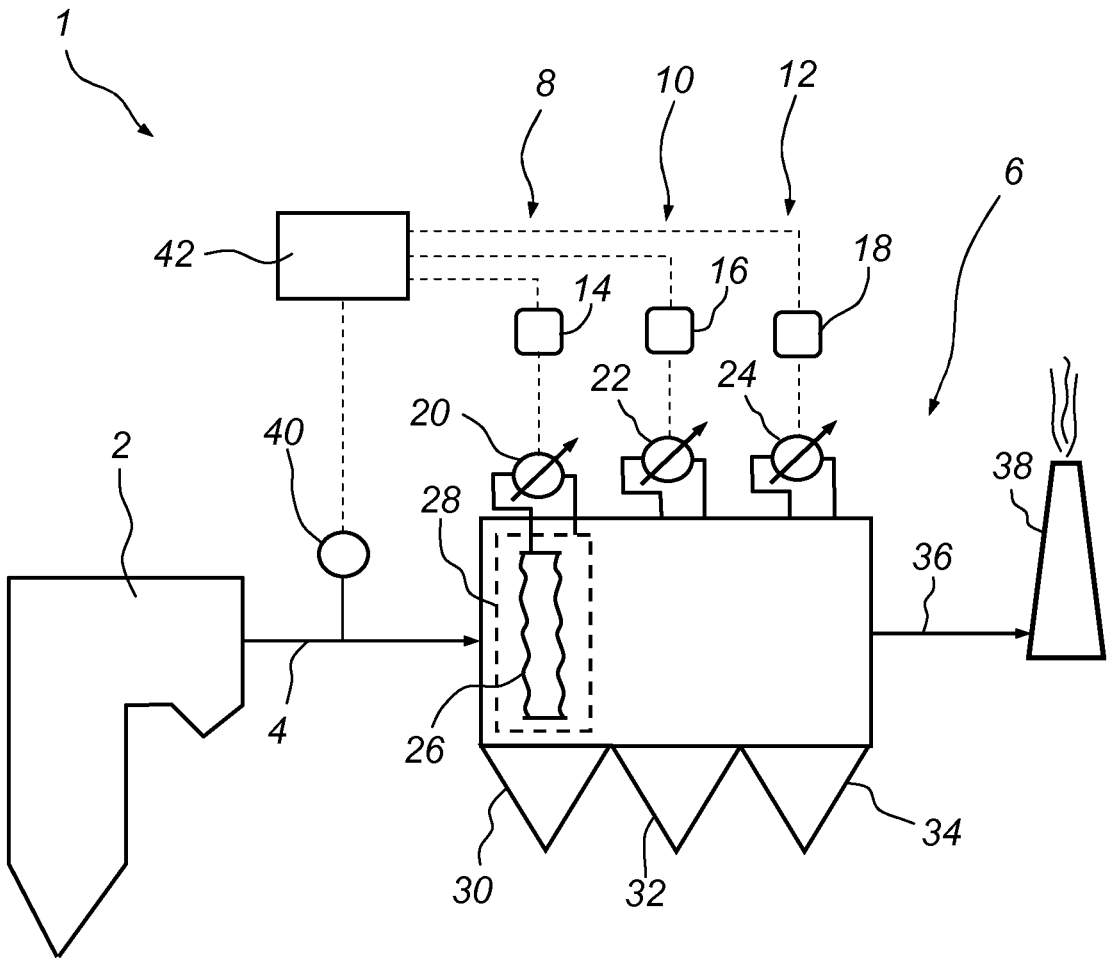
FIG. 1 is a schematic side view of a power plant.

FIG. 1 is a schematic side view and illustrates a power plant 1, as seen from the side thereof. The power plant 1 comprises a coal fired boiler 2. In the coal fired boiler 2 coal is combusted in the presence of air generating a hot process gas in the form of so-called flue gas that leaves the coal fired boiler 2 via a duct 4. The flue gas generated in the coal fired boiler 2 comprises dust particles, that must be removed from the flue gas before the flue gas can be emitted to the ambient air. The duct 4 conveys the flue gas to an electrostatic precipitator, ESP, 6 which with respect to the flow direction of the flue gas is located downstream of the boiler 2. The ESP 6 comprises what is commonly referred to as a first field 8, a second field 10, and a third field 12, arranged in series, as seen with respect to the flow direction of the flue gas. The three fields 8, 10, 12 are electrically insulated from each other. Each of the fields 8, 10, 12 is provided with a respective control device 14, 16, 18 controlling the function of a respective rectifier 20, 22, 24.

Each of the fields 8, 10, 12 comprises several discharge electrodes and several collecting electrode plates, although FIG. 1, in the interest of maintaining clarity of illustration therein, only illustrates one discharge electrode 26 and one collecting electrode plate 28 of the first field 8. In FIG. 1 it is schematically illustrated how the rectifier 20 applies power, i.e., voltage and current, between the discharge electrodes 26 and the collecting electrode plates 28 of the first field 8 to charge the dust particles that are present in the flue gas. After being so charged, the dust particles are collected on the collecting electrode plates 28. A similar process occurs in the second and third fields 10, 12. The collected dust is removed from the collecting electrode plates 28 by means of so-called rapping devices, not shown in FIG. 1, and is finally collected in hoppers 30, 32, 34.

A duct 36 is provided that is designed to be operative for forwarding flue gas, from which at least part of the dust particles have been removed, from the ESP 6 to a stack 38. The stack 38 releases the flue gas to the atmosphere.

A temperature sensor 40 is operative for measuring the temperature in the flue gas that is conveyed in the duct 4. The temperature sensor 40 sends a signal, which contains information about the measured flue gas temperature, to the plant control computer 42. The plant control computer 42 sends, in its turn, signals containing information about the measured flue gas temperature to each of the control devices 14, 16, 18. The control devices 14, 16, 18 controls the operation of the respective rectifiers 20, 22, 24 in accordance with principles that will be explained in more detail below.

Figure 2:
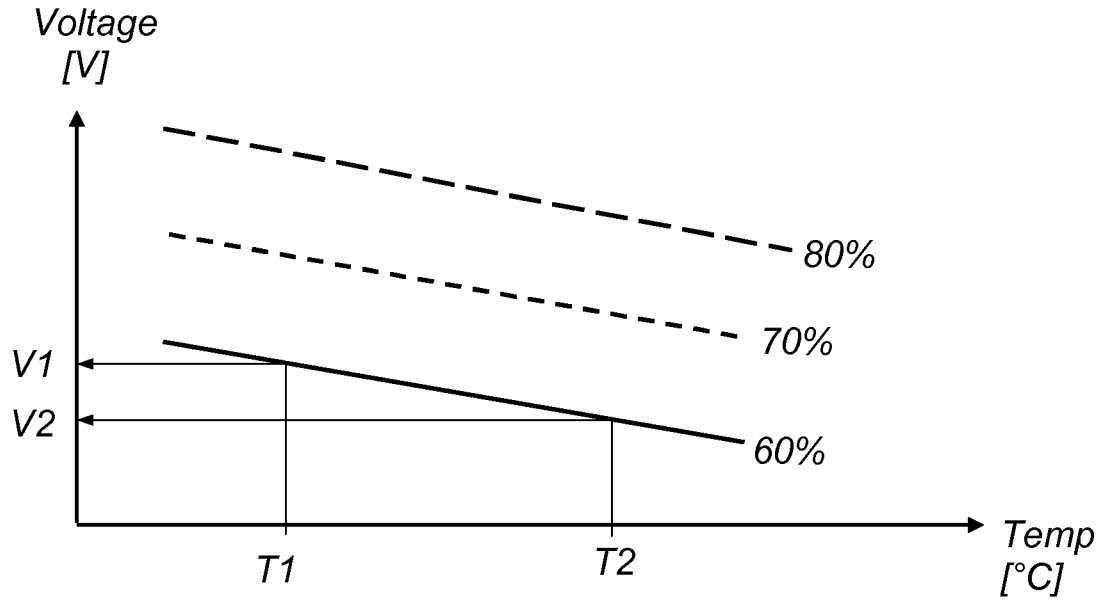
FIG. 2 is a schematic diagram illustrating the dust particle removal efficiency of a field of an electrostatic precipitator versus the voltage applied.

FIG. 2 is a schematic diagram, and illustrates one of the findings upon which the present invention is based. The y-axis of the diagram illustrates the voltage applied, by means of the rectifier 20, between the discharge electrodes 26 and the collecting electrode plates 28 of the first field 8, illustrated in FIG. 1. The x-axis of the diagram of FIG. 2 illustrates the temperature in the flue gas as measured by means of the temperature sensor 40 illustrated in FIG. 1. The diagram of FIG. 2 illustrates three curves, each corresponding to a fixed dust particle removal efficiency of the first field 8. In FIG. 2 these curves correspond to 60%, 70%, and 80% dust particle removal efficiency of the first field 8. As could be expected a higher removal efficiency requires a higher voltage. It has now been found, as is illustrated in FIG. 2, that the power, and, hence, the voltage required to achieve a certain removal efficiency is lower at a higher flue gas temperature, than at a lower flue gas temperature. Thus, for example, the voltage V1, which is required to obtain 60% removal efficiency at a first temperature T1, is higher than the voltage V2 which is required to obtain that same removal efficiency at a second temperature T2, which is higher than the first temperature T1.

The removal of dust particles in the electrostatic precipitator 6 depends, among other things, on the extent of the electrical corona generated around the discharge electrodes 26. A certain removal efficiency of dust particles corresponds to a certain extent of the corona. One possible explanation to the behaviour illustrated in FIG. 2 is that the voltage required to generate a corona of a certain extent at a high flue gas temperature is lower than the voltage required to generate a corona of that same extent at a low flue gas temperature.

Figure 3:
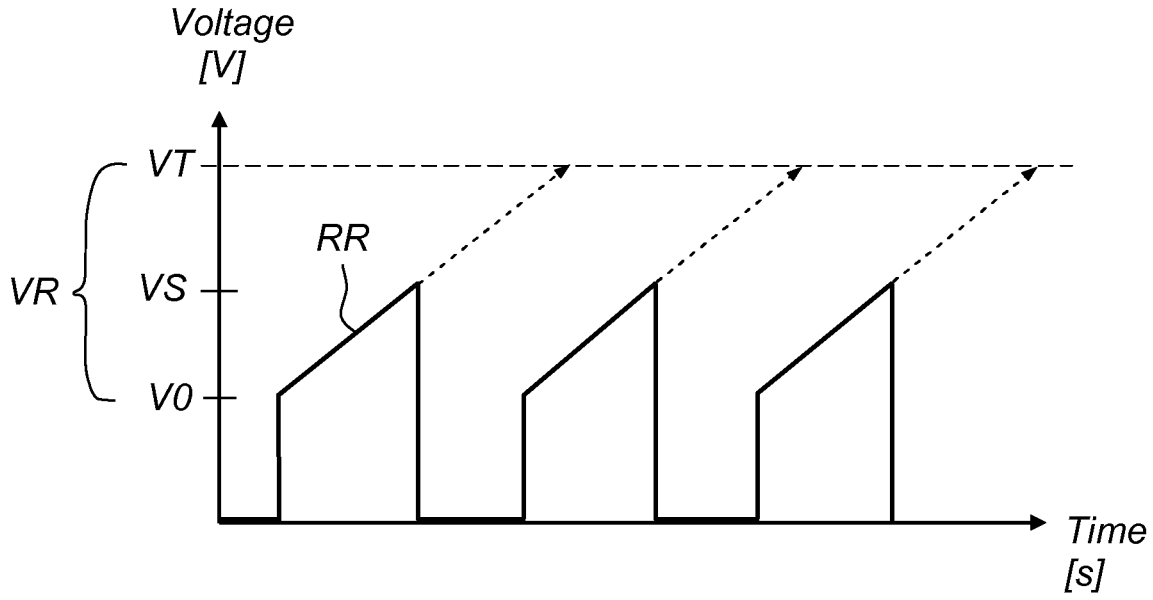
Prior art Fig. 3
FIG. 3 is a schematic diagram illustrating a voltage control method in accordance with the prior art.

FIG. 3 illustrates a power control method in accordance with a prior art technique. In FIG. 3 the power control of a first field is illustrated, but it will be appreciated that in accordance with the prior art method a similar technique would be applied for all fields of an electrostatic precipitator.

In the method illustrated in FIG. 3 the control device controlling the rectifier of the first field controls the voltage within a set voltage range VR. The voltage range VR has a lower level V0 and target voltage level VT. The control device urges the rectifier to apply a starting voltage, being the voltage V0, and to then increase the voltage at a certain voltage ramping rate RR, being the derivative of the voltage curve of FIG. 3. The objective of the control method in accordance with the prior art is to a apply the voltage level V0 and to increase the voltage at the voltage ramping rate RR to reach the target voltage level VT, the intended path of the voltage being indicated by arrows in FIG. 3. However, at a voltage VS a spark-over occurs between the discharge electrodes and collecting electrode plates and the control device may urge the rectifier to cut the power. After a short period of time, e.g., 1-30 ms, the control device urges the rectifier to apply the voltage V0 and to increase the voltage again, in accordance with the voltage ramping rate RR, with the objective of reaching the target voltage VT. It will be appreciated that the voltage VS at which the rate of spark-overs reaches its limit will vary over time, due to varying operating conditions as regards load of dust particles, etc., of the electrostatic precipitator.

Figure 4:
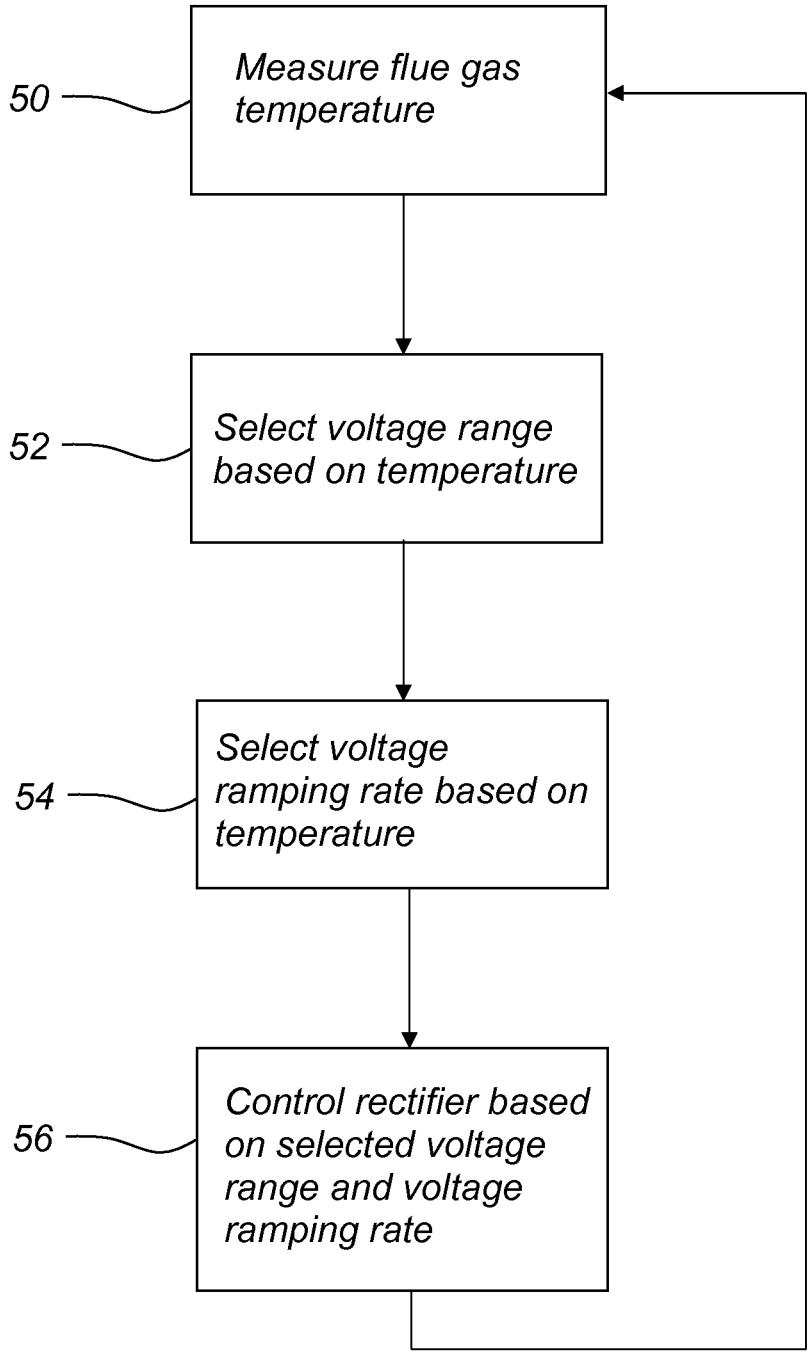
FIG. 4 is a flow-diagram illustrating a method of controlling an electrostatic precipitator in accordance with one embodiment of the present invention.

FIG. 4 illustrates an embodiment of the present invention. This embodiment is based on the finding illustrated in FIG. 2, i.e., that the temperature of the flue gas influences the power required to achieve a sufficient dust particle removal efficiency. In the embodiment illustrated with reference to FIG. 4 the power applied by the rectifier 20 illustrated in FIG. 1 is controlled indirectly by controlling the voltage.

In a first step, the latter being illustrated as 50 in FIG. 4, the temperature of the flue gas is measured, e.g., by means of the temperature sensor 40 illustrated in FIG. 1. In a second step, the latter being illustrated as 52 in FIG. 4, a voltage range is selected based on the temperature as measured in the first step. In a third step, the latter being illustrated as 54 in FIG. 4, a voltage ramping rate is selected based on the temperature as measured in the first step. In a fourth and final step, the latter being illustrated as 56 in FIG. 4, the voltage applied by the rectifier, e.g. the rectifier 20, between the discharge electrodes 26 and the collecting electrode plates 28 is controlled in accordance with the selected voltage range and the selected voltage ramping rate. Furthermore, as depicted in FIG. 4 by means of a loop, the flue gas temperature is then measured again and a new voltage range and a new voltage ramping rate is selected. The frequency of selecting new voltage ranges and new voltage ramping rates can be set based on the expected stability of the flue gas temperature. For some plants it might be sufficient to select new voltage ranges and new voltage ramping rates once every hour, while other plants may require much more frequent selection of voltage ranges and voltage ramping rates, due to the temperature of the flue gas fluctuating at a high frequency.

It will be appreciated that the control method illustrated in FIG. 4 could be applied to each of the control devices 14, 16, 18, or to only one or two of them.

Figure 5:
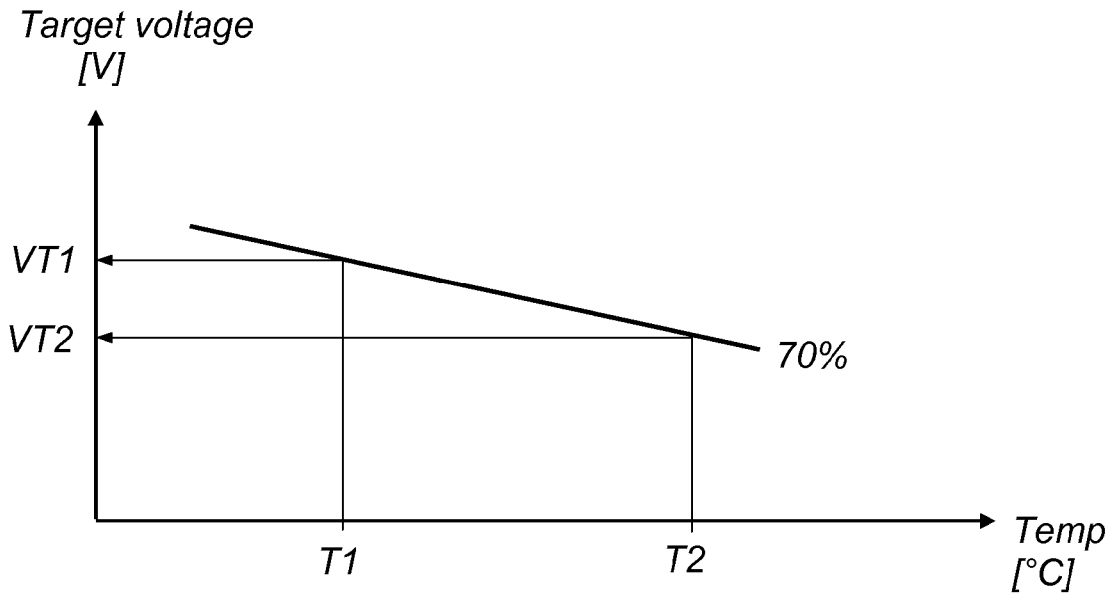
FIG. 5 is a schematic diagram illustrating a relation between the flue gas temperature and a target voltage.

FIG. 5 illustrates schematically how a target voltage value can be selected based on the flue gas temperature. The curve illustrated in the diagram of FIG. 5 reflects the desired dust removal efficiency, i.e., 70%. At a temperature T1 of, e.g., 150° C. a target voltage value VT1 is selected, as depicted in FIG. 5. At a temperature T2 of, e.g., 200° C. a target voltage value VT2 is selected, as depicted in FIG. 5. The target voltage value VT2 selected at the temperature T2 is, as depicted in FIG. 5, lower than the target voltage value VT1 selected at the temperature T1, such temperature T1 being lower than the temperature T2. Based on the selected target voltage value a voltage range is selected. The voltage range at the temperature T1 could be selected to start at a lower voltage V0, and to end at the selected target voltage value VT1. The voltage range at the temperature T2 could be selected to start at the same lower voltage V0, and to end at the selected target voltage value VT2. Hence, the voltage range will be more narrow at the temperature T2.

Figure 6:
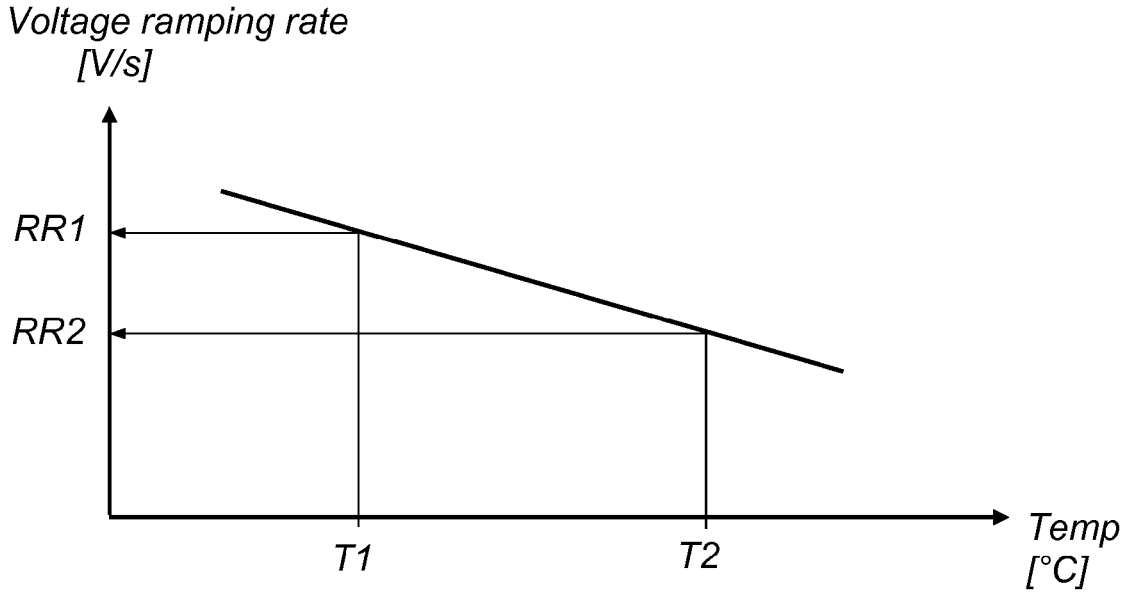
FIG. 6 is a schematic diagram illustrating a relation between the flue gas temperature and a voltage ramping rate.

FIG. 6 illustrates schematically how a voltage ramping rate value can be selected based on the flue gas temperature. The curve illustrated in the diagram of FIG. 6 reflects empirically found suitable values of voltage ramping rate vs. flue gas temperature. The voltage ramping rate value describes the rate of increasing the voltage in the selected voltage range. The unit of the voltage ramping rate is volts/second. At a temperature T1 of, e.g., 150° C. a voltage ramping rate value RR1 is selected, as depicted in FIG. 6. At a temperature T2 of, e.g., 200° C. a voltage ramping rate value RR2 is selected, as depicted in FIG. 6. The voltage ramping rate value RR2 selected at the temperature T2 is, as depicted in FIG. 6, lower than the voltage ramping rate value RR1 selected at the temperature T1, such temperature T1 being lower than the temperature T2.

Figure 7:
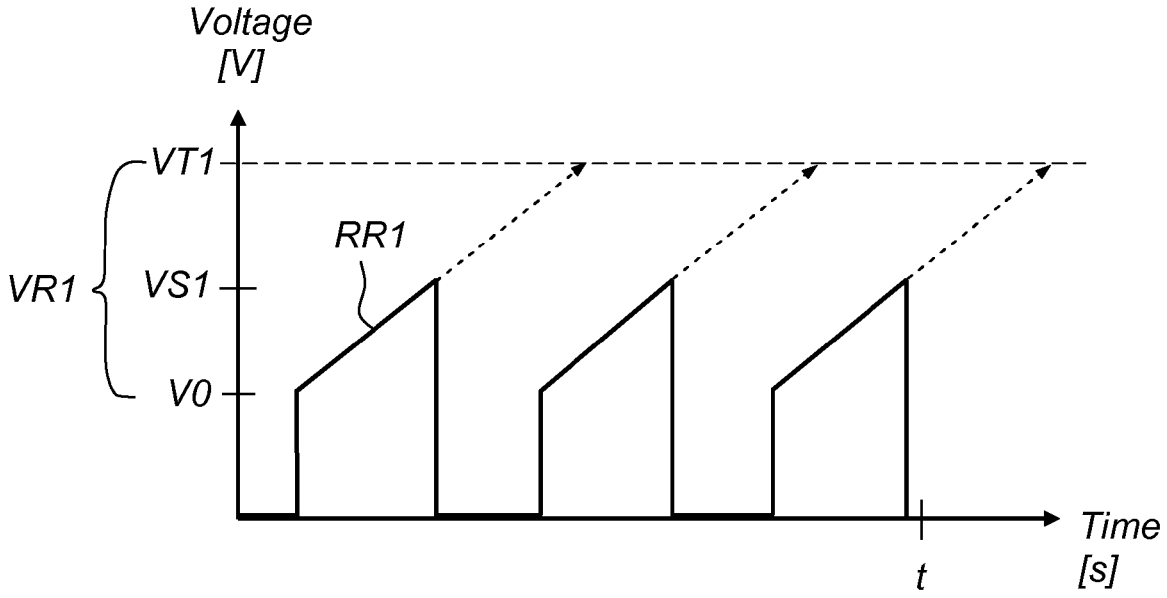
FIG. 7 is a schematic diagram illustrating the operation of an electrostatic precipitator at a low flue gas temperature.

FIG. 7 illustrates the power control method in accordance with an embodiment of the present invention and at a temperature T1 of, e.g., 150° C. Again, the power applied by means of the rectifier 20 is controlled indirectly by controlling the voltage. In FIG. 7 the voltage control of the first field 8 is depicted, but it will be appreciated also the second and third fields 10 and 12 could be controlled in accordance with a similar principle.

In the method depicted in FIG. 7 the control device 14 controlling the rectifier 20 of the first field 8 controls the voltage within the selected voltage range VR1, such voltage range extending from the lower voltage V0 and up to the selected target voltage value VT1, the selection of which has been described hereinbefore with reference to FIG. 5. The control device 14 urges the rectifier to apply a starting voltage, being the lower voltage V0, and to increase the voltage at the selected voltage ramping rate value RR1, the selection of which has been described hereinbefore with reference to FIG. 6. The objective of the control device 14 is to increase the voltage at the voltage ramping rate value RR1 to reach the target voltage value VT1, the intended path of the voltage being indicated by broken arrows in FIG. 7. However, at a voltage around the value VS1 a spark-over occurs between the discharge electrodes 26 and the collecting electrode plates 28 and the control device 14 may urge the rectifier 20 to cut the power. After a short period of time, e.g., 1-30 ms, the control device 14 urges the rectifier 20 to apply the voltage V0 and to increase the voltage again, in accordance with the voltage ramping rate value RR1, with the objective of reaching the target voltage VT1. During a time t, depicted in FIG. 7, totally three cycles of cutting the voltage occurs.

Figure 8:
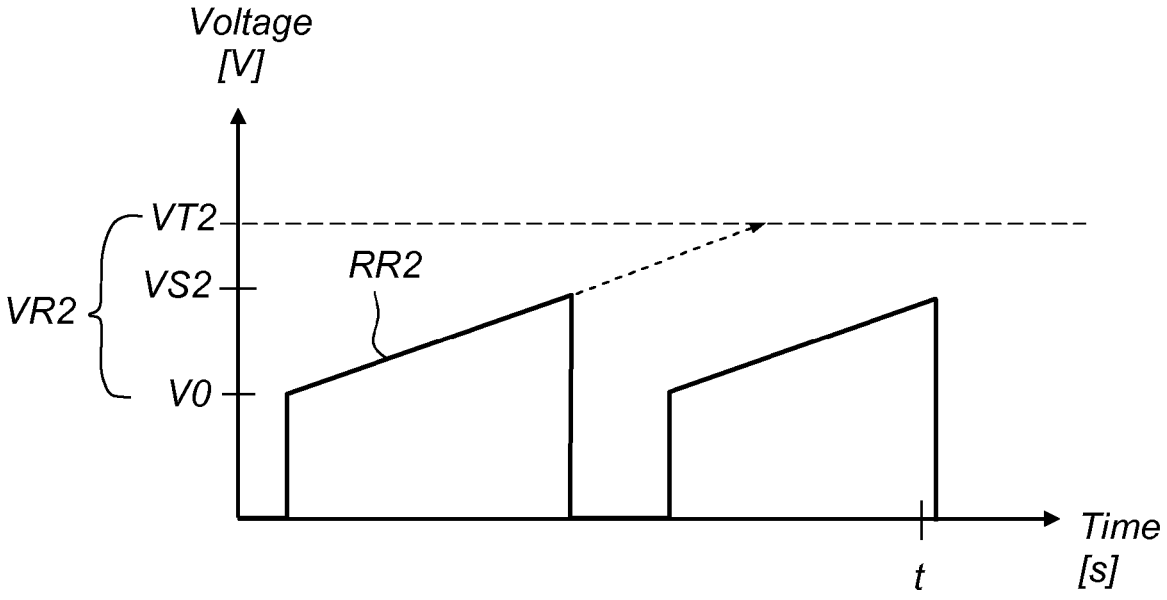
FIG. 8 is a schematic diagram illustrating the operation of an electrostatic precipitator at a high flue gas temperature.

FIG. 8 illustrates the power control method in accordance with an embodiment of the present invention and at a temperature T2 of, e.g., 200° C. As in the case illustrated in FIG. 7, the power applied by the rectifier 20 is controlled indirectly by means of controlling the voltage. In FIG. 8 the voltage control of the first field 8 is depicted, but it will be appreciated also the second and third fields 10 and 12 could be controlled in accordance with a similar principle.

In the method depicted in FIG. 8 the control device 14 controlling the rectifier 20 of the first field 8 controls the voltage within the selected voltage range VR2, such voltage range extending from the lower voltage V0 and up to the selected target voltage value VT2, the selection of which has been described hereinbefore with reference to FIG. 5. The control device 14 urges the rectifier 20 to apply a starting voltage, being the lower voltage V0, and to increase the voltage at the selected voltage ramping rate value RR2, the selection of which has been described hereinbefore with reference to FIG. 6. The objective of the control device 14 is to increase the voltage at the voltage ramping rate value RR2 to reach the target voltage value VT2, the intended path of the voltage being indicated by a broken arrow in FIG. 8. However, at a voltage around the value VS2 a spark-over occurs between the discharge electrodes 26 and the collecting electrode plates 28 and the control device 14 may urge the rectifier 20 to cut the power. After a short period of time, e.g., 1-30 ms, the control device 14 urges the rectifier 20 to apply the voltage V0 and to increase the voltage again, in accordance with the voltage ramping rate value RR2, with the objective of reaching the target voltage VT2. During a time t, being that same time as illustrated in FIG. 7, less than two cycles of cutting the voltage occurs, as depicted in FIG. 8.

From a comparison between FIG. 7 and FIG. 8 it can be seen that the higher temperature T2, as is depicted in FIG. 8, causes fewer cycles of cutting the power to occur per unit of time, compared to the number of cycles of cutting the power at the lower temperature T1, as is depicted in FIG. 7. The effect is that at the higher temperature T2 the mechanical and electrical strain on the rectifier 20 and the other electrical equipment is reduced, thereby increasing the life of the electrostatic precipitator 6. Furthermore, the electrical energy supplied to the field 8, such electrical energy supply being proportional to the voltage multiplied by the time, i.e., being proportional to the area under the voltage curve of FIG. 8, increases due to the fewer power cuts. The increased electrical energy supplied at the flue gas temperature T2 increases the removal efficiency of the electrostatic precipitator.

Hence, by accounting for the flue gas temperature in the control of an electrostatic precipitator it is possible to increase the effectiveness of such control and to reduce the wear on the mechanical and electrical components by decreasing the number of spark-overs and by minimising the risk of arcing. The total power input may also increase, leading to an increased dust particle removal efficiency.

Figure 9:
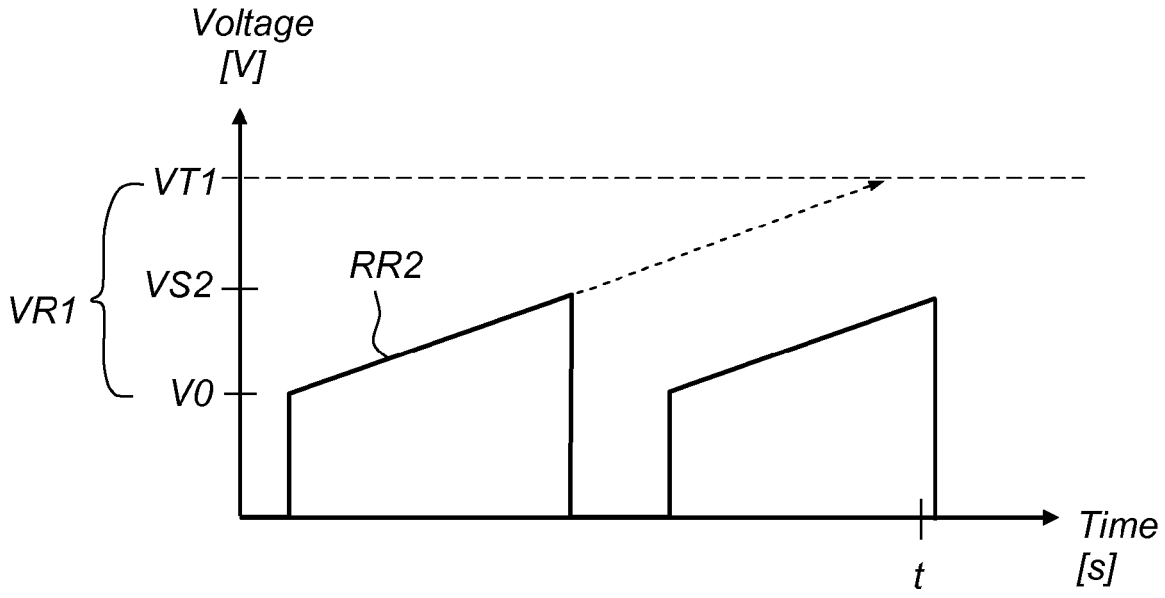
FIG. 9 is a schematic diagram illustrating the operation of an electrostatic precipitator in accordance with an alternative embodiment of the present invention.

FIG. 9 illustrates an alternative embodiment of the present invention. In accordance with this embodiment the flue gas temperature is accounted for only in the selection of the voltage ramping rate value, but not in the selection of the voltage range, the latter being kept constant, independently of the flue gas temperature. FIG. 9 illustrates the situation at a high temperature, T2. The selected target voltage value VT1 and the selected voltage range VR1 would be the same as when operating at a low temperature, compare the situation depicted in FIG. 7. The voltage ramping rate value RR2 at the high temperature T2 has been selected based on the diagram shown in FIG. 6. When comparing the voltage curve of FIG. 9 with that of FIG. 8 it is clear that the number of power cuts and the supplied electrical energy is rather similar in those two cases. However, the voltage range VR1 of the method depicted in FIG. 9 is wider than the voltage range VR2 of the method depicted in FIG. 8, and this may, in some situations, lead to an increased electrical strain on the rectifier 20 when operating in accordance with the method depicted in FIG. 9, compared to operating in accordance with the method depicted in FIG. 7 and FIG. 8.

Figure 10:
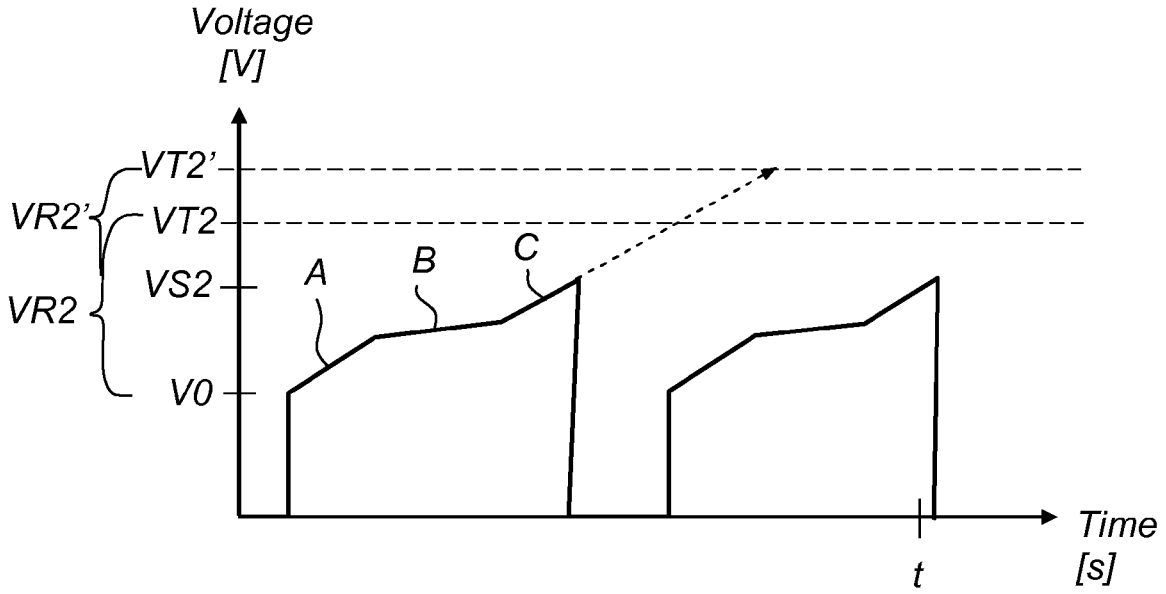
FIG. 10 is a schematic diagram illustrating the operation of an electrostatic precipitator in accordance with a further alternative embodiment of the present invention.

FIG. 10 illustrates a further alternative embodiment of the present invention. The situation depicted in FIG. 10 is similar to that of FIG. 8, i.e., the power control has been adapted to a high temperature of, e.g., 200° C. by utilizing a power ramping rate which is lower than that which is utilized at a lower flue gas temperature. The difference compared to the situation in FIG. 8 is that the voltage ramping rate is not constant during the entire ramping phase. Hence, as illustrated in FIG. 10, the voltage ramping rate is initially rather high, as indicated in FIG. 10 by means of a voltage ramping rate A. Then the voltage ramping rate is decreased, as indicated by a voltage ramping rate B. Finally, the voltage ramping rate is again increased, as indicated by a final voltage ramping rate C. One advantage of varying the voltage ramping rate during one and the same sequence is that more power may be introduced in the electrostatic precipitator, since the high initial voltage ramping rate A rather quickly brings the power to a high level. Then this high power level is maintained for a rather long period of time during the low voltage ramping rate B. Finally, the high voltage ramping rate C makes it possible to reach the spark-over situation rather quickly. It will be appreciated that the ramping rate within one and the same sequence can be varied also in other ways to achieve other effects.

According to a further alternative embodiment it is possible to vary the selected voltage range VR2 during one and the same ramping sequence to improve the control of the amount of power introduced into the electrostatic precipitator. Hence, as illustrated in FIG. 10, the selected voltage range VR2 could have a first value during the initial part of the ramping sequence. During a later part of the ramping sequence the selected target voltage value could be increased from VT2 to VT2' forming a new selected voltage range VR2' which is wider than the initial selected voltage range VR2.

Hence, it is possible to vary either the voltage ramping rate or the voltage range, or to vary both the voltage ramping rate and the voltage range during one and the same ramping sequence, as illustrated in FIG. 10. In the latter case the selection of the voltage ramping rate and the selection of the voltage range during one and the same ramping sequence could either be dependent or independent of each other.

It will be appreciated that numerous variants of the embodiments described above are possible within the scope of the appended claims.

Above it has been described, with reference to FIGS. 4-10, that the power applied by the rectifier, such power being the product of the current and the voltage applied, is controlled indirectly by means of controlling the voltage applied, i.e., by means of controlling the voltage range and/or the voltage ramping rate. At the same time the current may be kept constant, or may vary. In the latter case, the current would normally increase at the same time as the controlled parameter, i.e., the voltage, increases, thus resulting in the power, being the product of the current and voltage, increasing. It will be appreciated that other alternatives are also possible. One such alternative is to control the power applied by the rectifier indirectly by means of controlling the current range and/or the current ramping rate, in accordance with similar principles as have been described hereinbefore with reference to FIGS. 4-10 concerning the voltage range and the voltage ramping rate. Still further, it would also be possible to control the power indirectly by controlling the voltage and the current simultaneously, i.e., by controlling the voltage and current ranges and/or the voltage and current ramping rates. In accordance with a still further embodiment it would also be possible to have the controller 42 controlling the power directly, i.e., by controlling the power range and/or the power ramping rate in accordance with similar principles as have been described hereinbefore with reference to FIGS. 4-10 concerning the voltage range and the voltage ramping rate. Hence, the power could either be controlled directly or indirectly, such indirect controlling comprising controlling the voltage and/or the current.

Hereinbefore it has been described that the temperature of the flue gas is measured in the duct 4 upstream of the electrostatic precipitator 6. It will be appreciated that the flue gas temperature can be measured in other locations as well, for example in the duct 36 or even inside the electrostatic precipitator 6 itself. The important issue is that the measurement must give a relevant indication of the conditions as regards the flue gas temperature inside the electrostatic precipitator 6.

Hereinbefore it has been described, with reference to FIGS. 4-8 and 10, that both the voltage range and the voltage ramping rate can be selected based on the flue gas temperature. Furthermore, it has been described hereinbefore, with reference to FIG. 9, that only the voltage ramping rate can be selected based on the flue gas temperature, the voltage range being constant, independently of the flue gas temperature. It will be appreciated that it would also be possible, as a still further alternative, to only select the voltage range based on the flue gas temperature, and to keep the voltage ramping rate constant, independently of the flue gas temperature. Hence, it is possible to select the voltage ramping rate, or the voltage range, or both, with regard to the flue gas temperature at which the electrostatic precipitator 6 is operating. This applies in a similar manner to cases in which the current is controlled instead of, or together with, the voltage, and to cases in which the power is controlled directly. Thus, a power ramping rate, or a power range, or both, may be selected with regard to the flue gas temperature.

As described hereinbefore, each of the control devices 14, 16, 18 is operative for receiving a signal containing information about the flue gas temperature, and to select a power range and a power ramping rate accordingly. As one alternative a central unit, such as the plant control computer 42, could be operative for receiving the signal containing information about the flue gas temperature, and to select the power range, and/or the power ramping rate, which are then distributed to each of the control devices 14, 16, 18.

While the present invention has been found to be effective for most types of dust particles, it has been found to be particularly efficient for so-called low resistivity dusts, i.e., dusts having a bulk resistivity of less than 1*10E10 ohm*cm, as measured in accordance with, e.g., IEEE Std 548-1984: "IEEE Standard Criteria and Guidelines for the Laboratory Measurement and Reporting of Fly Ash Resistivity", of The Institute of Electrical and Electronics Engineers, Inc, New York, USA.

It has been described hereinbefore that the target voltage value is selected based on the flue gas temperature, and that the selected target voltage value is utilized for selecting a voltage range within which the voltage is controlled. In the examples described hereinbefore a lower voltage V0 of the selected voltage ranges has always been fixed, independently of the flue gas temperature. It will be appreciated, however, that it is possible to select also the lower limit, i.e., the lower voltage V0, of the voltage range based on an operating parameter, such as the measured flue gas temperature. In the latter case the lower voltage V0 of the respective voltage range could be lower at higher flue gas temperatures than at lower flue gas temperatures.

To summarize, a method of controlling the operation of an electrostatic precipitator 6 comprises utilizing a control strategy for a power to be applied between at least one collecting electrode 28 and at least one discharge electrode 26, said control strategy comprising controlling, directly or indirectly, a power range and/or a power ramping rate. The temperature of said process gas is measured. When said control strategy comprises controlling the power range, a power range VR1, VR2 is selected based on said measured temperature, an upper limit value VT1, VT2 of said power range being lower at a high temperature T2 of said process gas, than at a low temperature T1. When said control strategy comprises controlling the power ramping rate, a power ramping rate RR1, RR2 is selected based on said measured temperature, said power ramping rate being lower at a high temperature T2 of said process gas, than at a low temperature T1. The power applied between said at least one collecting electrode 28 and said at least one discharge electrode 26 is controlled in accordance with said control strategy.

The invention claimed is:

1. A method of controlling operation of an electrostatic precipitator for removing dust particles from a process gas comprising:

utilizing a control strategy for a power to be applied between at least one collecting electrode and at least one discharge electrode, said control strategy comprising controlling, directly or indirectly, at least one of a power range and a power ramping rate, measuring the temperature of said process gas, selecting, when said control strategy comprises controlling the power range, a power range based on said measured temperature, an upper limit value of said power range being lower at a high temperature of said process gas, than at a low temperature of said process gas, selecting, when said control strategy comprises controlling the power ramping rate, a power ramping rate based on said measured temperature, said power ramping rate being lower at a high temperature of said process gas, than at a low temperature of said process gas, and controlling the power applied between said at least one collecting electrode and said at least one discharge electrode in accordance with said control strategy.

2. A method according to claim 1, further comprising utilizing a relation between the process gas temperature, and the power applied between said at least one collecting electrode and said at least one discharge electrode when selecting said power range and/or said power ramping rate.

3. A method according to claim 1, wherein said control strategy comprises controlling the power ramping rate.

4. A method according to claim 1, wherein said control strategy comprises controlling both the power range and the power ramping rate.

5. A method according to claim 1, wherein said control strategy comprises applying at least two different power ramping rates during one and the same ramping sequence.

6. A method according to claim 1, wherein said control strategy comprises applying at least two different power ranges during one and the same ramping sequence.

7. A device for controlling the operation of an electrostatic precipitator for removing dust particles from a process gas comprising:

a controller for controlling a power applied between at least one collecting electrode and at least one discharge electrode in accordance with a control strategy for the power to be applied between said at least one collecting electrode and said at least one discharge electrode, said control strategy comprising controlling, directly or indirectly, at least one of a power range and a power ramping rate, the controller operative for receiving a signal indicating the temperature of the process gas and for selecting, when said control strategy comprises controlling the power range, a power range based on said measured temperature, an upper limit value of said power range lower at a high temperature of said process gas, than at a low temperature of said process gas, and/or selecting, when said control strategy comprises controlling the power ramping rate, a power ramping rate based on said measured temperature, said power ramping rate lower at a high temperature of said process gas, than at a low temperature of said process gas.

8. A device according to claim 7, wherein said device is operative for utilizing a relation between the process gas temperature and the power applied between said at least one collecting electrode and said at least one discharge electrode when selecting said power range and/or said power ramping rate.

9. A device according to claim 7, wherein said control strategy comprises controlling the power ramping rate.

10. A device according to claim 7, wherein said control strategy comprises controlling both the power range and the power ramping rate.

11. A device according to claim 7, wherein said control strategy comprises applying at least two different power ramping rates during one and the same ramping sequence.

12. A device according to claim 7, wherein said control strategy comprises applying at least two different power ranges during one and the same ramping sequence.

* * * * *